United States Patent [19]

Borer et al.

[11] 4,052,153

[45] Oct. 4, 1977

[54] HEAT RESISTANT CRUCIBLE

[75] Inventors: Werner J. Borer, Henggart; Tibor Kugler, Thayngen; Walter Schmidt; Walter Stählin, both of Schaffhausen, all of Switzerland

[73] Assignee: Prolizenz AG, Chur, Switzerland

[21] Appl. No.: 661,434

[22] Filed: Feb. 26, 1976

[30] Foreign Application Priority Data

Mar. 6, 1975 Switzerland ..... 2844/75

[51] Int. Cl.[2] ..... F27B 14/00; F27B 14/10

[52] U.S. Cl. ..... 432/156; 432/264; 432/265

[58] Field of Search ..... 432/156, 262, 264, 263, 432/265; 13/30, 35

[56] References Cited

U.S. PATENT DOCUMENTS

| | | | |
|---|---|---|---|
| 2,947,114 | 8/1960 | Hill | 432/264 |
| 3,470,017 | 9/1969 | Rubin et al. | 432/264 |
| 3,961,905 | 6/1976 | Rice | 432/262 |

FOREIGN PATENT DOCUMENTS

| | | | |
|---|---|---|---|
| 1,522,509 | 3/1968 | France | 13/35 |
| 726,993 | 3/1932 | France | 432/156 |

*Primary Examiner*—John J. Camby
*Attorney, Agent, or Firm*—Ernest F. Marmorek

[57] ABSTRACT

A crucible, for use in heating and/or retaining melts at elevated temperatures, includes a hollow holding member composed of a heat resistant material, and a thin-walled insert composed of a substance chemically resistant to oxygen and oxidizing substances and being removably supported in the holding member.

15 Claims, 4 Drawing Figures

HEAT RESISTANT CRUCIBLE

CROSS-REFERENCE TO RELATED APPLICATIONS

Reference is had to the copending patent applications of Walter Schmidt, Ser. Nos. 661,433; 661,439; and 661,438 (each filed on Feb. 26, 1976); and application Ser. No. 664,700 of said Walter Schmidt filed on Mar. 8, 1976 each entitled "CRUCIBLE".

BACKGROUND OF THE INVENTION

The invention relates to a crucible for use in heating and/or retaining melts at elevated temperatures.

Generally, prior art crucibles of this type are composed of one of the platinum metals such as iridium having a melting point of 2,454° C. In the case of crystal growing, a melt is prepared and a seed crystal is introduced therein while the temperature and movement of the seed crystal from the melt is controlled to produce a cylindrical crystal.

The prior art iridium crucibles have been found to be disadvantageous because of the short term of use due to corrosion. Iridium is relatively resistant to oxidizing substances but the corrosion results from the extended period of time which can be from a few hours to a few days for the crystal growing process. The corrosion of the inside surface of the crucible by certain melts causes the inside of the crucible to become rough and increases the exposed surface area so that the corrosion process is increased. The corrosion process is known to be a function of temperature and is highest in the regions of the higher temperatures.

In the case of a crucible heated directly by the field of an induction coil, an uneven temperature distribution along the crucible axis arises due to asymmetry and inhomogeneity.

The relatively short period of use for a crucible sometimes requires a change in the crucible being used for a process requiring a relatively long period of time. The high cost of iridium compels the salvaging of the corroded crucible for use to form a new crucible. Even when the used crucibles are used to produce a new crucible, the production costs are very high because the iridium can only be processed at a temperature of about 1,200° C.

The instant invention endeavors to eliminate many of the known disadvantages of the aforementioned crucibles including the reduction of corrosion, the reduction of production costs for the material, and the reduction of the cost for molding the crucibles.

SUMMARY OF THE INVENTION

One of the principal objects of the invention is a crucible, for use in heating and/or retaining melts at elevated temperatures, including a hollow holding member composed of a heat resistant material, and a thin-walled insert composed of a substance chemically resistant to oxygen and oxidizing substances and being removably supported in the holding member.

The use of a thin-walled insert provides the clean and smooth surface needed for the growth of a crystal while the material cost is considerably less than the prior art crucibles. Generally, five to ten thin-walled inserts can be made from the material in a single conventional crucible about the same size.

The holding member provides the required mechanical strength to the crucible and could be made of iridium because it is not directly in contact with the metal melt.

Preferably, the holding member is formed of a heat resistant material which resists oxidation and is stable at elevated temperatures in the order of 3,000° C and includes a metallic component such as a plasma-sprayed ceramic oxide and metal inserts imbedded therein and enclosed on all sides. Ceramic oxides such as zirconium oxide, aluminim oxide, and magnesium oxide are suitable and are considerably less expensive than the use of iridium for the holding member. For these ceramic oxides, the metallic component provides sufficient electrical conductivity for inductive heating.

Further objects and advantages of the invention will be set forth in part in the following specification and in part will be obvious therefrom without being specifically referred to, the same being realized and attained as pointed in the claims hereof.

The invention accordingly comprises the features of construction, combination of elements and arrangements of parts which will be exemplified in a construction hereinafter set forth and the scope of the application of which will be indicated in the claims.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

In carrying the invention into effect, some embodiments have been selected for illustrations in the accompanying drawings and for description in the specification, reference being had to FIGS. 1A, 1B, 2A, and 2B.

Figure 1A:
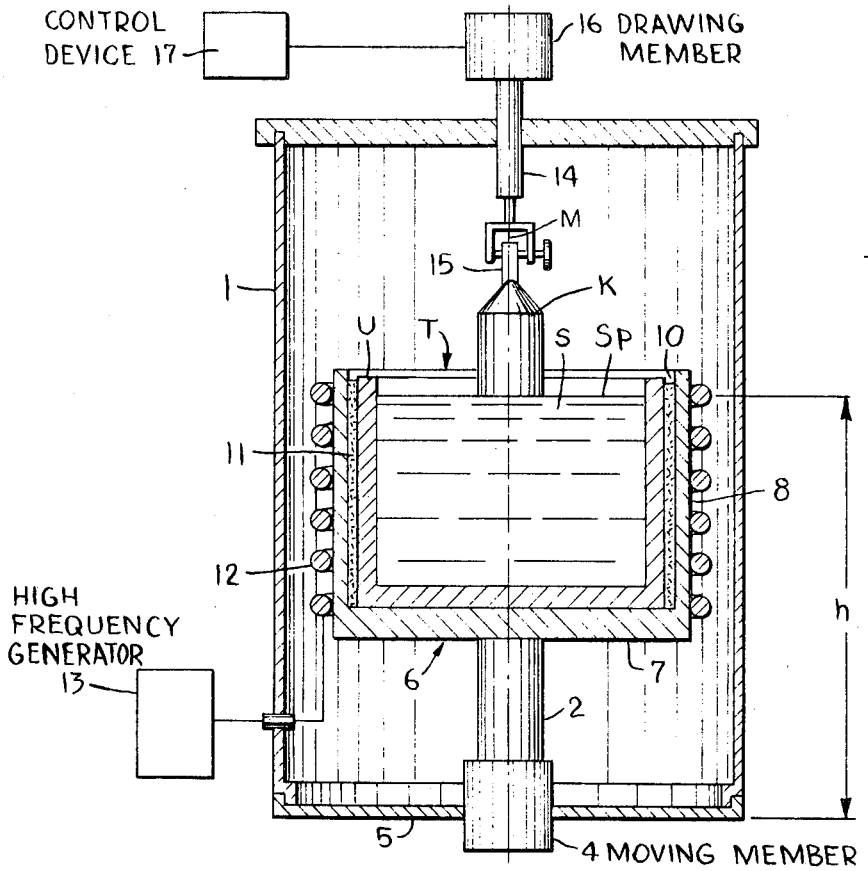
FIG. 1A shows a partial vertical sectional view of one embodiment of a crystal drawing device.
Figure 1B:
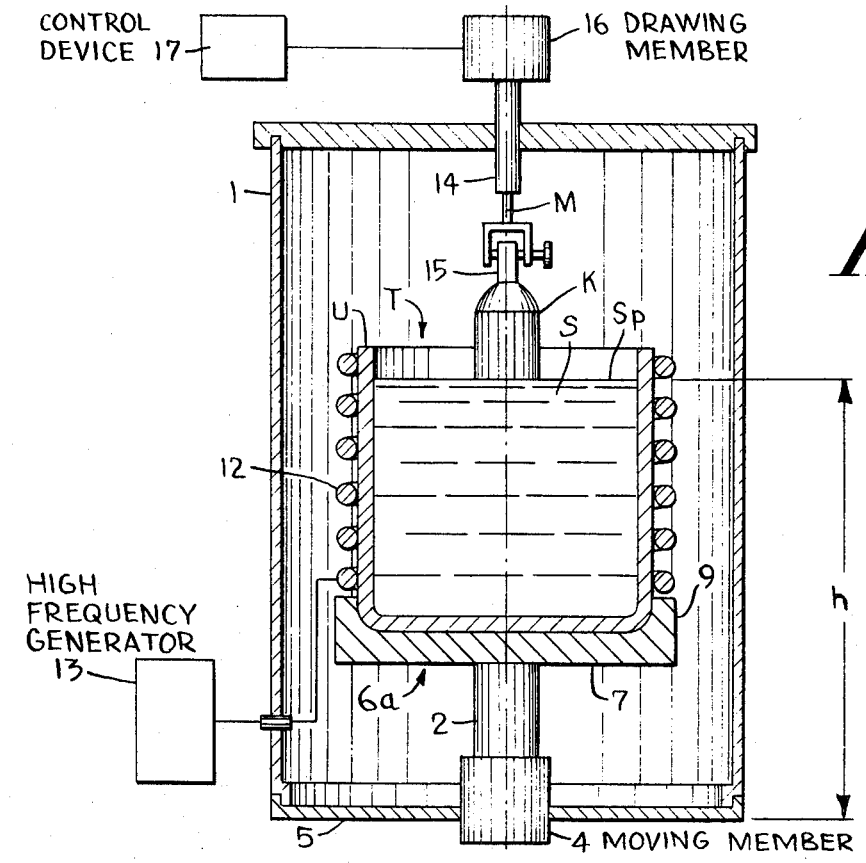
FIG. 1B shows a partial vertical sectional view of another crystal drawing device.

Generally, FIGS. 1A and 1B show devices for growing a single crystal according to the so-called Czochralski process. In FIG. 1A, housing 1 encloses a supporting device 6 for a crucible T arranged on a vertical shaft 2 extending along the axis M of the device 6. The shaft 2 can be vertically displaced by a moving member 4 so that the level Sp of a melt S in the crucible T is kept at a constant distance *h* from the bottom surface 5 of the housing 1.

The supporting device 6 includes a bottom plate 7 and an insulating wall 8. In contrast, FIG. 1B shows a supporting device 6*a* including a bottom plate 7 and an annular flange 9.

FIG. 1A shows a cylindrical vertical wall U of the crucible T and the insulating wall 8 define an annular region 10 which is filled with powdered aluminum oxide 11.

In both FIGS. 1A and 1B, heat is generated by a high-frequency induction coil 12 connected to a high-frequency generator 13.

In operation, a seed crystal 15 extends from the vertical drawing rod 14 into the melt S and is slowly withdrawn by a drawing member 16 to produce a crystal K.

The drawing member 16 is operated by a control device 17.

Figure 2A:
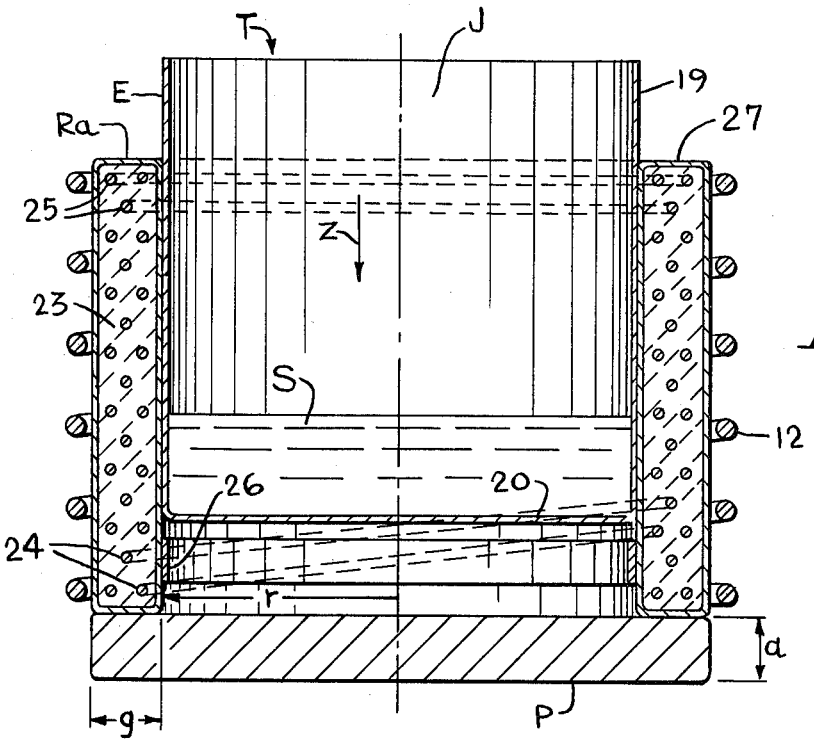
FIG. 2A shows a partial vertical sectional view of one embodiment according to the invention.
Figure 2B:
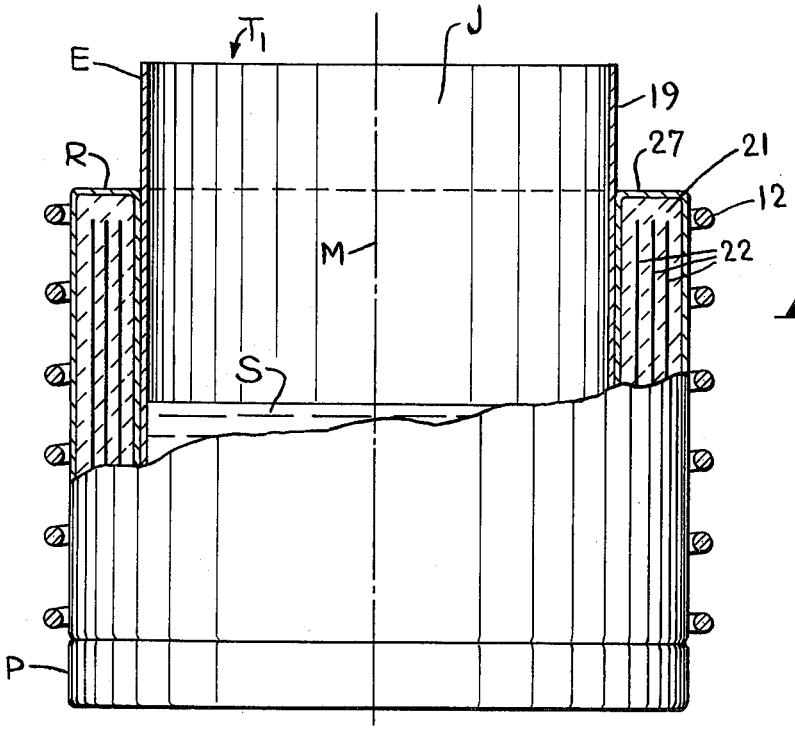
FIG. 2B shows a partial vertical sectional view of another embodiment according to the invention.

FIGS. 2A and 2B show the crucible T includes a thin-walled insert cup E and a holding member R*a* and R, respectively. Preferably, the internal radius r of the holding members R is slightly larger than three times the holding member thickness *g*. The insert E is removably inserted into the holding members R and R*a* in the direction shown by Z.

The insert E and its holding member are disposed on a fireproof base-plate P having a height of a and composed of magnesium oxide. The baseplate is removably positioned below the holding member and is operable to close the bottom thereof. The combination of the insert E, holding member $R_a$ or R and base-plate *p* forms crucible unit $T_1$. The growth area for the crystal K is defined by the inner area J bordered by the crucible-wall 19 and the crucible-bottom 20. Typically, the insert E can be made from one of the platinum metals such as iridium and can have a wall thickness of about 0.3 mm. A temperature of about 1,800° C is obtained from the inductive heating of the high-frequency heating-coil 12.

The holding member $R_a$ includes a plasma sprayed ceramic oxide body 23 and metal 24 helicoidally or spirally disposed or metal 25 in the form of rings. The metals 24 and 25 can be iridium.

The holding member R can be made from a ceramic oxide 21 such as $ZrO_2$ or CaO each having resistance to oxidation at the operating temperatures of about 1,900° C. The holding member R includes cylinders 22 composed of iridium foils and imbedded concentrically with respect to the axis M.

Between the crucible wall 19 and the holding member $R_a$ there is disposed an intermediate layer 26, for example a liquid, in order to facilitate the displacement of the insert E along the inner surface of the holding member Ra. A protective cover layer 27 can be used to protect the bodies 21 and 23.

The cylinders 22, and metals 24 and 25 reinforce the members $R_a$ and R and compensate for the brittleness of the ceramic oxides in a surprising manner. They also tend to compensate for thermo-shock-sensitivity. In addition, they have a favorable affect with respect to the heating of the holding member to an elevated temperature.

When the holding member is heated, in its normal use, the ceramic oxide reaches elevated temperatures and becomes electrically conductive so that the high-frequency electromagnetic field produced by the coil 12 can couple into it to generate additional heat. In addition, the insert E serves as a heating element because it couples to the high-frequency field.

The holding member $R_a$ and R each have a very long useful life so that the cost for producing the crystal K is considerably reduced. There is an intrinsic advantage in that the high-frequency field coupling does not involve only the insert E, but includes the holding member R and Ra so that undesirable temperature gradients can be diminished to avoid localized overheating. This tends to extend the useful life of the insert E and tends to avoid the contamination of the melt S by the iridium so that a qualitatively high-grade crystal K is obtained.

I with it to be understood that I do not desire to be limited to the exact details of construction shown and described, for obvious modifications will occur to persons skilled in the art.

Having thus described the invention, what I claim as new and desire to be secured by Letters Patent, is as follows:

1. A crucible, for use in heating and/or retaining melts at elevated temperatures, comprising in combination:

a holding member composed of a heat-resistant material open at the bottom;

a fire-proof base-plate removably positioned below said holding member and operable to close said bottom; and a thin-walled insert cup composed of a substance chemically resistant to oxygen and oxidizing substances and being removably supported in said holding member above said base-plate.

2. The crucible as claimed in claim 1, wherein said material is chemically resistant to oxidation at elevated temperatures and includes a metallic component.

3. The crucible as claimed in claim 1, wherein said material comprises a ceramic oxide.

4. The crucible as claimed in claim 3, wherein said ceramic oxide is plasma sprayed zirconium oxide or aluminum oxide and at least one metallic layer embedded therein.

5. The crucible as claimed in claim 4, wherein said metallic layer is a platinum metal and extends through said holding member.

6. The crucible as claimed in claim 5, wherein there are a plurality of said metallic layers each being cylindrical and approximately concentric with respect to the axis of said insert.

7. The crucible as claimed in claim 5, wherein there are a plurality of the metal layers each being a ring disposed about said insert.

8. The crucible as claimed in claim 5, wherein there are a plurality of metallic layers each being approximately helical and composed of iridium.

9. The crucible as claimed in claim 1, further comprising a protective layer disposed on the surface of said holding member.

10. The crucible as claimed in claim 9, wherein the width of said protective layer is approximately 0.3 mm.

11. The crucible as claimed in claim 1, further comprising an intermediate layer disposed between said insert cup and said holding member.

12. The crucible as claimed in claim 11, wherein said intermediate layer is a liquid.

13. The crucible as claimed in claim 1 wherein said base-plate comprises magnesium oxide.

14. The crucible as claimed in claim 1 wherein said thin-walled insert is composed of iridium.

15. The crucible as claimed in claim 1 wherein the thickness of said insert cup is approximately 0.3mm.

* * * * *